United States Patent [19]

Hogg

[11] Patent Number: 4,762,355

[45] Date of Patent: Aug. 9, 1988

[54] SELF EQUALIZING LIFTING DEVICE

[76] Inventor: John P. C. Hogg, 2 Ghyll Beck Drive, Rawdon Leeds LS19 6RB, England

[21] Appl. No.: 758

[22] Filed: Jan. 6, 1987

Related U.S. Application Data

[63] Continuation-in-part of Ser. No. 858,918, May 2, 1986, abandoned.

[30] Foreign Application Priority Data

Jun. 26, 1985 [GB] United Kingdom ..... 8516149

[51] Int. Cl.[4] ..... B65H 57/14; B66C 1/14

[52] U.S. Cl. ..... 294/82.12; 294/74

[58] Field of Search ..... 294/82.12, 74, 82.11, 294/86.41, 97; 254/391, 392, 390, 389

[56] References Cited

U.S. PATENT DOCUMENTS

| | | | |
|---|---|---|---|
| 2,356,147 | 8/1944 | Caldwell | 294/82.12 |
| 2,629,625 | 2/1953 | Phillips | 294/82.12 |
| 3,709,548 | 1/1973 | Hogshead | 294/82.12 |

FOREIGN PATENT DOCUMENTS

| | | | |
|---|---|---|---|
| 1389151 | 4/1975 | United Kingdom | 294/82.12 |

*Primary Examiner*—James B. Marbert
*Attorney, Agent, or Firm*—Fred Philpitt

[57] ABSTRACT

The invention is a lifting device for use in lifting a load. The device is used for example between a crane hook and the lifting chains attached to the load. The device hooks onto the crane hook and the chain passes over a guide wheel which in one position, when the chain does not take the weight of the load, the wheel can turn freely enabling the device to be moved horizontally relative to the load to any desired location, and when the chain does take the load, the wheel is placed in a locked position so that it cannot turn and by this means the device can be positioned so as to ensure that when the load is lifted it will be in a predetermined position e.g. level. The wheel is carried by a spindle, the ends of which pass through slots in a pair of side plates of the device and when the device is loaded, the spindles rest on the bottoms of the slots ensuring that the plates take the load. The guide wheel has teeth of which adjacent teeth engage on opposite sides of a pin which prevents the wheel from turning but the pin is located so as not to be directly loaded by the load. When the device is unloaded, the teeth are moved clear of the pin and the wheel can rotate.

11 Claims, 6 Drawing Sheets

SELF EQUALIZING LIFTING DEVICE

This is a continuation-in-part of application Ser. No. 858,918, filed May 2, 1986, now abandoned, and the benefits of 35 USC 120 are claimed relative to it.

This invention relates to a lifting device, and in particular concerns a self equalizing device for the lifting of heavy loads such as for example from several tons to tens of tons. The device can be used for the lifting of any loads, light or heavy, as will be clear from the following explanation, but as will also be understood its best application is in relation to the lifting of heavy industrial loads.

In industry, especially in the engineering industry, frequently there is a requirement to lift a heavy load such as a lathe, or a turbine or generator, in order to install, reposition or remove such load. These loads are lifted by power cranes which my be gantry or jib cranes or factory installed cranes. The lifting ropes or cables suspend a hook block, and typically between the hook block and the load is connected a chain sling unit which may comprise an eye fitting in the hook of the hook block and one or more chains extending from the eye to points of attachment on the load, or to points of attachment on an intermediate beam, the intermediate beam having one or more chain slings extending therefrom and being connected to the load.

A major difficulty in the lifting of loads using conventional chain slings is that if the load, as is usually the case, is an assymetrical load i.e. the position of the centre of gravity is unknown and cannot readily be predicted, then it becomes a matter of trial and error as to where the hooks of the chain slings should be attached to the load in order to keep the load level or at a predetermined attitude during lifting. Frequently, after attachment of the chain slings to the load, the load is simply lifted and then its angular position examines by eye. If it is offset from a required attitude, the load is again lowered and the chains re-positioned, and the process repeated until the load takes up the required attitude during lifting. As can be appreciated, this practice is dangerous because the connection positions for the sling chains have to be repeatedly changed, and there is the danger that an imperfect connection may be made, which means that there is a danger that the sling chain could slip from the load, and the load could fall when suspended.

Also, the lifting and lowering of the load is time consuming.

There are several known self equalizing devices designed to obviate the problem outlined above. Several known types of self equalizing devices are disclosed in U.S. Pat. Nos. 2,356,147, 2,463,240 and 2,661,231 to Caldwell which disclose self equalizing lifting devices comprising a wheel over which a chain or cable passes, the ends of the chain or cable being for attachment to a load. When the load is lifted through the device, the wheel is displaced downwardly into a frictional engagement with a restraining pad or disc. When the device is lowered so as not to support the load, springs lift the wheel away from the restraining device so that the device can be repositioned so that it is more accurately positioned over the centre of gravity of the load. These devices rely on the frictional grip between the wheel and the pads to prevent slip, but these devices are of doubtful security and safety insofar as if the devices are used on outdoor applications then the friction surfaces can be effected by atmospheric conditions, foreign bodies or oil on the friction surfaces, which could lead to slippage of the device and dangerous instability of the load.

Another device of this type is disclosed in U.S. Pat. No. 4,139,179, but in this device it is necessary for an operator to remove a locking pin which locks the wheel in position when the device does not support the load. Therefore, to utilise the device requires an operator to insert and remove a locking pin. The device is therefore not of a semi-automatic nature as are the Caldwell devices and in fact the device therefore cannot be used at any substantial height because the operator would be required to mount a ladder or scaffolding in order to effect the adjustment.

U.S. Pat. No. 3,582,125 is again a manually operated chain sling device in which a locking device serves to lock the wheel over which the chain is trained when it is in the desired position. The locking device comprises a retractable block provided with teeth which engage teeth on the rim of the chain pulley.

A further self equalizing lifting device is disclosed in Russian Pat. No. 686969. The device in this patent similar to that disclosed in the Caldwell patent comprises a wire rope pulley which is spring loaded in an upwards direction. When the load is supported by the wire rope passing over the pulley, the pulley is urged downwards against the spring action, and teeth on the pulley engage opposite sides of a rotation prevention tooth provided on a plate located underneath the pulley. The teeth on the pulley and the tooth on the plate are of square cross section, and there is a danger that when the pulley is loaded, one of the teeth on the pulley will seat on the top of the tooth of the plate so that proper anti-rotation locking will not take place and the device will be unstable, but in any event even when locking does take place, the loading of the device is through the single tooth on the said plate so the said tooth not only acts to prevent rotation of the pulley, but also takes the entire thrust of the load, and it will therefore be subjected to high stress, high wear and eventually failure in a relatively short time.

Because these devices are used for the lifting of large and valuable loads, such as for example turbines and generators, it is vital that the devices be secure and safe and therefore a positive and secure support of the load is necessary. The devices according to the known arrangements fail to give consideration to the security and safety aspect, whereas the device of the present invention is constructed to provide a safe and secure lifting arrangement in a self equalizing device.

The present invention concerns a self equalizing device usable as part of the lifting tackle whereby in a simple and effective manner, adjustment of the lifting point in relation to the load centre of gravity can be effected so that relatively quickly, the load can be lifted in the desired attitude (usually level or relatively so) and furthermore the device will operate in a particularly safe and secure fashion.

In accordance with the invention, in a lifting device for lifting a load and comprising:

(a) a support block comprising a pair of spaced side plates having a top end and a bottom end;

(b) slots in said side plates and extending in a direction from top to bottom of said side plates;

(c) a guide wheel assembly comprising a spindle and a guide wheel body;

(d) ends on said spindle, said spindle ends received in said slots;

(e) sprocket teeth on said guide wheel body;

(f) a locking pin extending between said plates and located at the bottom ends of the side plates;

(g) spring means connected between the ends of the spindle and the side plates urging the wheel assembly towards the top ends of said side plates;

(h) suspension means at the top ends of the side plates by which the device may be suspended by a crane hook;

(i) a length of flexible suspension member passing over the wheel body and of which the ends are attached to a load when in use, the tension in the chain urges the wheel assembly towards the bottom ends of the side plates against the spring means, in which position the pin engages between the said teeth preventing rotation of the guide wheel body relative to the side plates, the improvement residing in that said slots and spindle are so arranged when the load supported by the device is greater than the spring force of the spring means the spindle rests on the bottom of the slots so that the plates take the load, the pin between the teeth taking no direct loading but serving only as a means resisting the turning of the guide wheel body.

By this arrangement, the lifting position through the lifting member can be adjusted in relation to the load centre of gravity so that relatively quickly, the device can be positioned approximately where required, for example over the centre of gravity of the load whereby lifting of the load in the required attitude can quickly be achieved.

The device in fact operates automatically and to adjust the position of the device, it is simply a matter of lowering the hook block of the crane until the tension in the lifting member becomes sufficiently slack for the spring means to lift the wheel to the free position. The device can then be moved laterally relative to the load to an adjusted position, for example closer to a position over the centre of gravity of the load, and then when the device is lifted again through the crane block, the wheel will automatically move to the lifting position.

To illustrate an example of the use of the device, assume that the lifting member length is connected by its ends to two points on a load, for example a lathe and the lathe is required to be lifted in a substantially level attitude. If, at first lift of the device, the lathe load tilts excessively i.e. the wheel is not above the lathe centre of gravity, this will be immediately obvious to an observer. If the load is so tilted, lifting is terminated and the load is returned to the ground. By the extent of tilt of the load, so the operator will know the direction in which the device of the invention is to be moved relative to the load centre of gravity and he therefore lowers the device until the wheel becomes free and the device can be moved horizontally until, by approximation, the device is over a position where the centre of gravity is believed to be. The device is then lifted and again the angle of lift of the load is observed. This process is repeated until the load takes up a level disposition when lifted. At each adjustment, the device is lowered only sufficiently to allow the lifting member to go slack and for the wheel to move to the free position.

It will be appreciated that the device can be used for lifting a load so that the load when lifted takes up a particular angle other than being level, if that is what is required, because although in the majority of cases it will be desired to lift the load in a level fashion, in some cases it may be desirable to lift the load so that it will be tilted at a particular angle. The device can be moved in relation to the lifting member so as to achieve lifting at that particular angle by the method described above.

A particular advantage of the device of the invention is that adjustment can be achieved without altering the fixing points of the lifting member to the load or to the intermediate beam.

With the device constructed in the preferred form indicated above, the device need not be located at hand level, as adjustment can be effected by movement of the crane suspending the block connected to the device.

The lifting member may be a length of link chain or it may be a length of belting or the like. When a link chain is used the links may drivingly engage in pockets in said wheel periphery to ensure that the chain does not slip relative to the wheel. When a belt is used, it may have teeth which engage teeth in the periphery of the wheel or it may simply engage frictionally on the wheel periphery to prevent slippage.

It will be appreciated that by constructing the invention so that the spindle of the guide wheel rests on the bottoms of the slots when the device is loaded, then all stress of a direct loading nature is removed from the locking pin which engages the teeth on the guide wheel. The pin therefore serves purely a locking function which ensures the safety and security of the device as compared to the arrangements adopted in the prior art.

Embodiments of the present invention will now be described, by way of example, with reference to the accompanying drawings, wherein.

Figure 1:
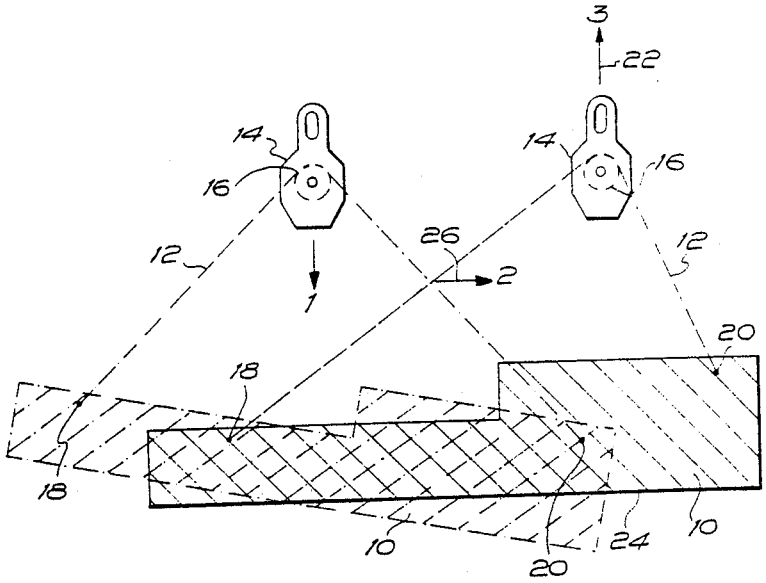
FIG. 1 is a diagrammatic side elevation to illustrate the utilisation of the invention.

Referring to the drawings, and firstly to FIG. 1, reference numeral 10 represents an assymetrical load such as a lathe or a turbine which is to be lifted by means of a length of flexible member 12 coupled to the device 14 of the invention. The chain 12 passes over wheel 16 of the device 14 and is attached to the load 10 at the points 18 and 20. In the full line position the device 14 is located approximately above the centre of gravity of the load 10, and therefore lifting the device as indicated by arrow 22 and hence lifting of load 10 ensures that the load 10 is lifted in a generally level fashion i.e. with its base surface 24 at least approximately horizontal.

Also in the figure the load 10 and member 12 are shown in dotted lines in a slightly different configuration, although the member 12 is connected to the same load points 18 and 20, but in this case the device 14 is positioned approximately over the mid length point of the load as opposed to over the centre of gravity. One should assume that the device 14 was positioned at the mid length position in the first instance, and when the device 14 was lifted, the load took up the tilted attitude shown in dotted lines in FIG. 1. The operator controlling the device 14 upon seeing the load take up or move towards this position would have immediately lowered the load back onto the ground, and then would have moved the device 14 in the direction of arrow 26 until the device 14 is positioned more over the centre of gravity, eventually reaching the full line position as shown in FIG. 1.

The device 14 is designed to operate so that the wheel 16 has a free running position enabling the movement of the device 14 relative to the member 12 for example as indicated by arrow 26, and a locked or lifting position in which the wheel 16 is locked so that the member 12 will not train round the wheel 16 when lifting is taking place as indicated by arrow 22.

From the information given herein, and from an understanding of the operation of the device shown in FIG. 1, it will be appreciated that the device 14 provides a considerable technical advantage compared to the conventional slinging of loads when the attachment points are constantly changed in an effort to reach a position in which the load will be lifted in a level fashion. It should be mentioned that if it is desired to lift the load so that when lifted the load will take up a pre-set angle, for example as indicated in dotted lines in FIG. 1, then the device 14 can be positioned accordingly. It may for example be desirable to hold a load at a particular angle when it has to be moved up a staircase or stairwell of which the steps are arranged on a flight at that particular angle.

The device 14 is constructed so that as long as the wheel 16 is urged downwardly by virtue of the tension in the member 12, the wheel will be held in the locked position, but when the load is supported on the ground, and the device 14 is lowered, as soon as the member 12 becomes slack the wheel 16 becomes free for rotation enabling the adjustment of the device as indicated by the arrow 26. In a modification, there may be an auxiliary locking device, such as a locking pin, which can lock the wheel in the locked position permanently until the auxilliary locking device is removed, which may be effected by hand.

Figure 2:
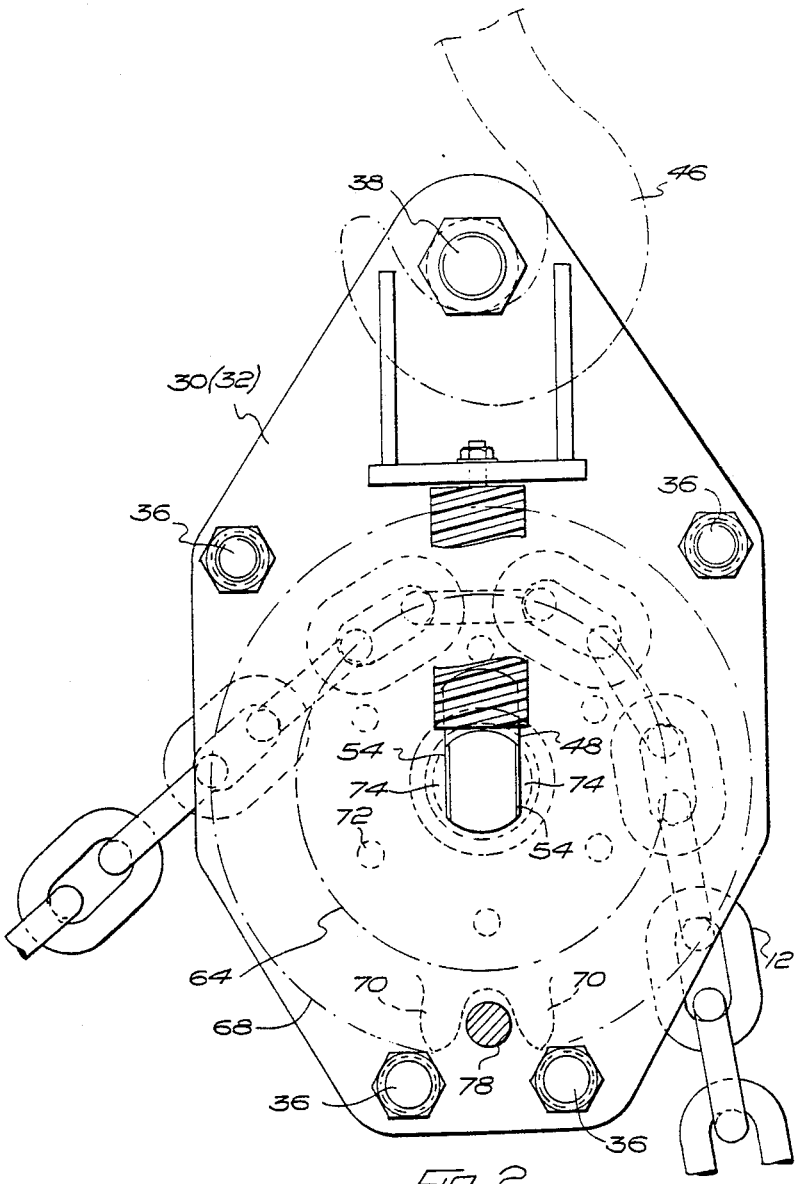
FIG. 2 is an enlarged side elevation of the device of the invention shown in FIG. 1 according to one embodiment thereof.
Figure 3:
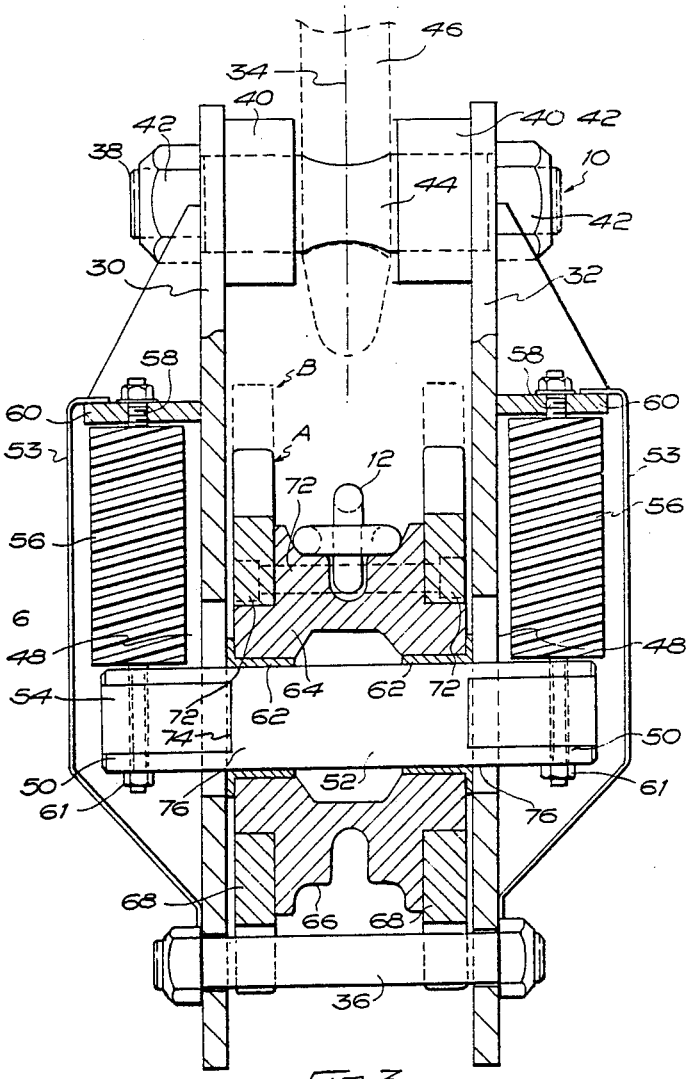
FIG. 3 is a central sectional elevation of the device shown in FIG. 2.
Figure 4:
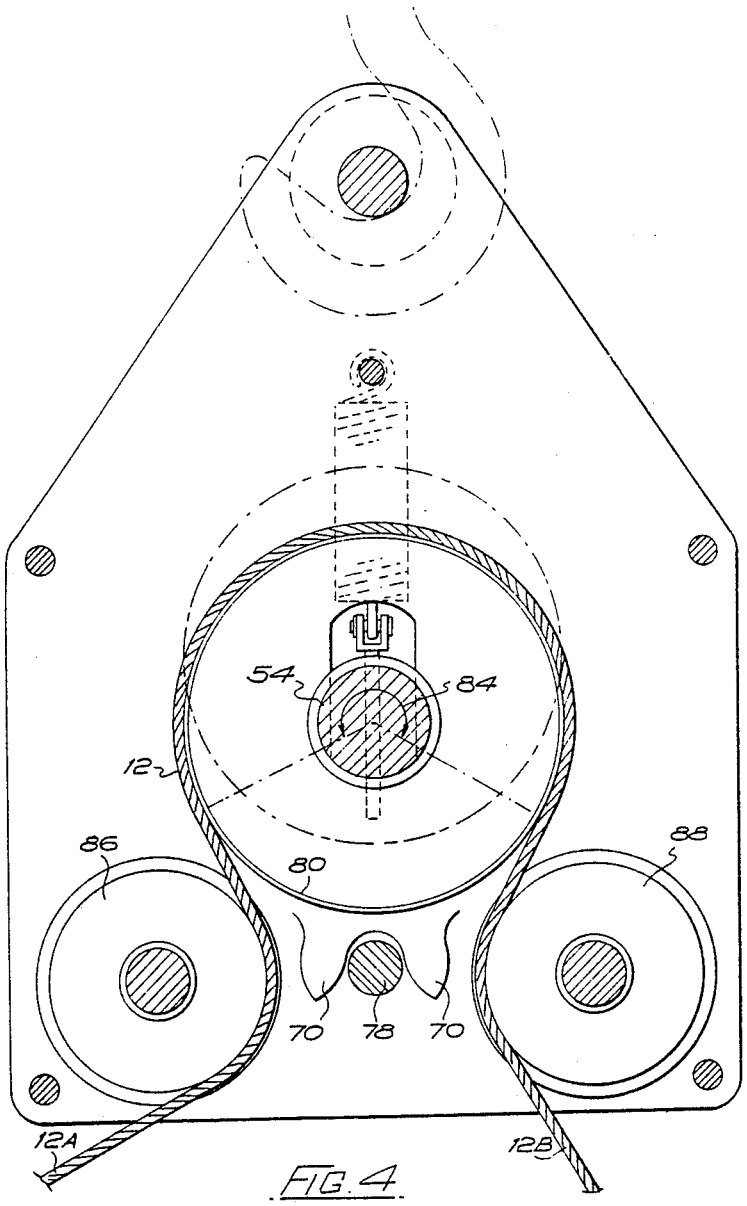
FIG. 4 is a view similar to FIG. 2, but in a sectional elevation, showing another embodiment of the invention.
Figure 5:
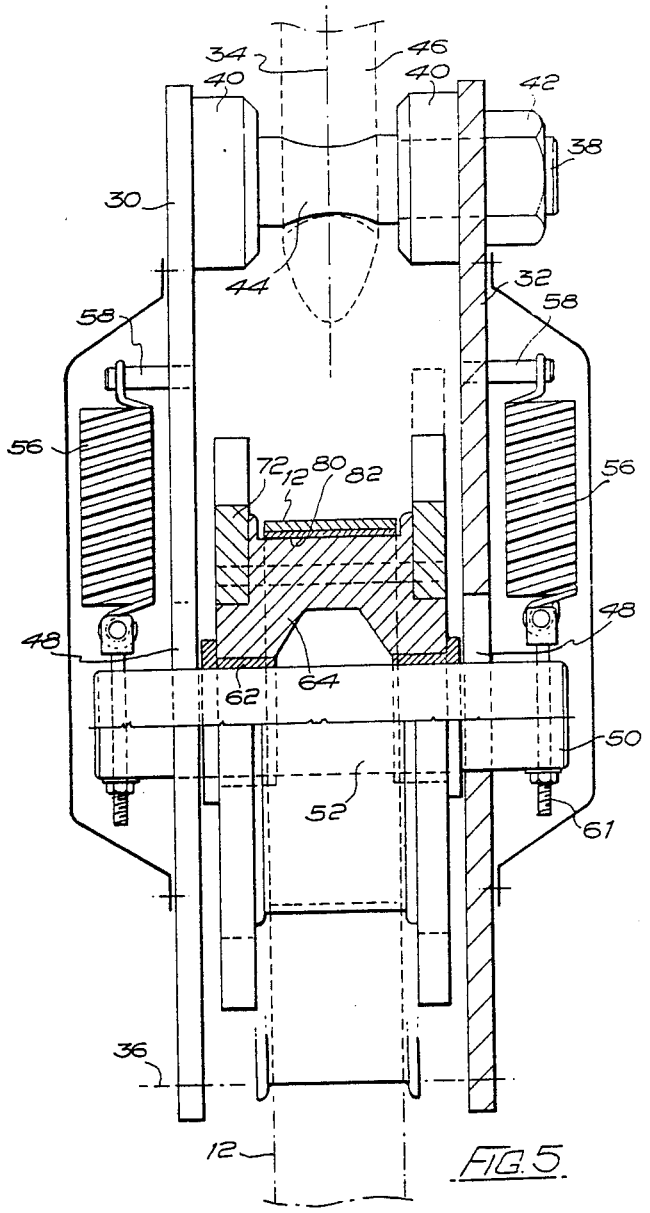
FIG. 5 is a centered sectional elevation of the device shown in FIG. 4.
Figure 6:
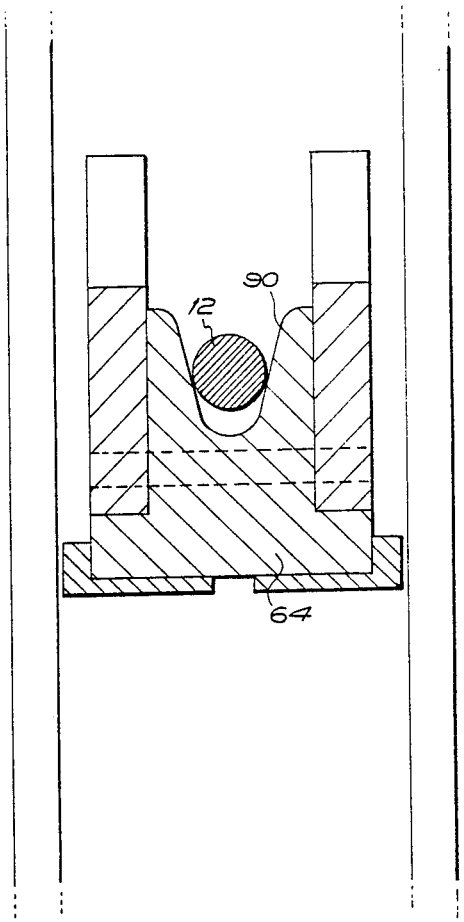
FIG. 6 is a sectional view of a detail showing a modification of the FIG. 5 arrangement.

The automatic lock and release of the device 14 may be achieved in any suitable manner, and the lifting member may be a chain as illustrated in FIGS. 2 and 3 or a belt or rope as illustrated in FIGS. 4, 5 and 6. FIGS. 2 to 6 also show constructional details of the device.

Referring to FIGS. 2 and 3, the device comprises a pair of steel side plates 30 and 32 which are symmetrically arranged around an axis 34 of symmetry of the device. The plates are secured together by means of shouldered bolts 36 and at the top of the plates by a large hook bolt 38, the bolt 38 being received in collars 40 on the inner surfaces of the plate, and being retained in position by nuts 42. A central section 44 of bolt 38 is of waisted configuration, for engagement with the lifting hook 46 of the hook block of the lifting crane. Instead of a hook bolt 38 the plates 30, 32 may be angled inwards so that the portions thereof come face to face and in such portions are eye holes for receiving securing hook 46.

The plates 32 are provided with elongated reception slots 48 having parallel sides and curved ends to receive the ends 50 of a spindle 52. The said ends 50 have flats 54 (FIG. 2) which face the straight portions of slots 48 whereby the spindle is prevented from turning about its axis, but in fact the spindle 52 can move vertically in the slots 48 between a lower and locked position, and an upper adjustment position, and to this end connected to the spindle ends are tension springs 56 which urge the spindle 52 to the upper position. The springs 56 are connected by bolts 58 to the mounting flanges 60 on the outside of plates 32, and to the ends 50 of the spindle 52. The springs are concealed and protected by cover plates 53.

Spindle 52 is provided with a pair of plane bearings 62 which rotatably support a chain wheel 64 (which is in fact wheel 16 in FIG. 1), the periphery of the chain wheel 64 being contoured as shown at 66 to receive the links of the chain 12 in a driving fashion so that a driving connection is established between the chain 12 and the wheel 64.

The wheel 64 is provided on its side faces with grooves receiving locking sprocket plates 68 having teeth 70 equally spaced therearound. The sprocket plates are secured to the wheel by bolts 72.

The spindle 52 is prevented from moving axially relative to the plates 32 by virtue of the shoulders 74 (FIG. 2) formed at the ends of the flats 54 lying adjacent the surfaces of the plates 32.

The operation of the device will be understood from the previous description, but if reference is made to FIG. 2 it can be explained that as long as the chain 12 is under tension i.e. in a load lifting condition, the net downward thrust by the chain on the wheel 64 displaces the wheel to the lowermost position in slots 48 and the spindle is supported on the slot bottoms 76 which take the weight of the load being lifted, and the teeth 70 of the sprocket plates lie to opposite sides of a locking pin 78 extending between the plates 68, so that the sprocket cannot turn about its axis and the chain 12 cannot feed around and rotate the sprocket. There is no direct loading on the pin 78 by the load, the pin serving only to prevent the rotation of the wheel. The load is therefore held stably and cannot tilt during lifting. When the load is lowered and is supported on the ground however, the continued lowering of the device allows the chain 12 to go slack and the springs 56 therefore commence lifting the wheel 64 and its sprocket plates 68 until the teeth 70 disengage from the pin 78, at which point wheel 64 can turn on spindle 52 and the device can be moved horizontally allowing the chain to feed round the wheel 64 as it rotates, permitting the device to take up a new position. It should be mentioned that the device is lowered only by an amount sufficient to allow the wheel 64 to turn, the springs taking the weight of the chain, and the chain will not therefore become uncontrollably slack. When the device has been re-positioned, and is again raised so that the chain 12 takes the load, the wheel will again be moved downwards until the teeth engage the locking pins 78 as shown in FIG. 2. It should be noted that the teeth 70, which are evently spaced around the wheel, are pointed so that as the wheel is being lowered towards the pin 78, which is round, the pin will always lie between a pair of its teeth effectively performing its function.

The extent of the movement of the wheel 64 is indicated by the full and chain dotted-line positions A and B indicated in FIG. 3, position A being the locked position and position B being the free position.

Referring now to the embodiment of the invention shown in FIGS. 4 and 5, and modification shown in FIG. 6, the essential difference from the FIGS. 2 and 3 embodiment is that instead of a chain, a friction belt is used in the case of FIGS. 4 and 5, and a friction rope sling is used in the case of FIG. 6 modification. Therefore, as many of the components of the device shown in FIGS. 4, 5 and 6 have already been described and illustrated in relation to FIGS. 2 and 3, these components will not be described specifically but do carry the same reference numerals as have been used in the FIGS. 2 and 3 embodiments.

Referring to FIG. 5, it will be noticed that the wheel 64 is provided with a flat peripheral portion 80 on which is carried a ring 82 of friction pad material. The chain 12 of the FIGS. 2 and 3 embodiment is replaced by a flat belt sling 12 which wraps around the wheel 64 and engages the friction ring 80 to the angular extent 84 shown in FIG. 4, which is in excess of 180°, and the belt 12 is guided onto the wheel 64 by means of a pair of symmetrically arranged flange guide pulleys 86, 88. The operation of the device of FIGS. 4 and 5 will be readily understood from previous consideration of the operation of the device in FIGS. 2 and 3. The frictional engagement of the belt 12 with the friction material ring 80 ensures that the belt will not slip relative to the wheel 64 when the device is performing a lifting operation, but when the load is supported and the belt is allowed to become slack so that the wheel 64 can lift to the raised position as described in relation to FIGS. 2 and 3, the wheel 64 can freely rotate so that the device can be moved laterally relative to the load.

This embodiment of the invention relies on the co-efficient friction between the sling belt 12 and the load wheel 64, and permits the loading of the different legs 12A and 12B of the belt 12 to be different. The tensions in the belt legs 12A and 12B with the configuration shown in FIG. 4 may be in a ratio of 3.5 to 4 before slippage of the belt relative to the wheel will occur.

In the modification shown in FIG. 6, a circular section lifting member 12 is used, and is in the nature of a rope sling, and the periphery of the wheel 64 is provided with a V-groove 90 for receiving the rope as shown clearly in FIG. 6. The rope will follow a path similar to the belt 12A as shown in FIG. 4.

The belts 12 of FIGS. 4 to 6 may be of rubber or reinforced rubber construction, and similarly the surfaces of the wheel which are engaged by the belts may be of a like material to ensure maximum co-efficient of friction between the belts and the wheel surface.

It will be readily understood that the invention provides a convenient lifting tackle adjustment device which can in the FIGS. 2 and 3 embodiments use a standard lifting chain or a belt or the like. The device can be used in connection with a chain or belt which is coupled to an intermediate lifting beam or the chain or belt 12 can form the sling coupling directly with the load as described.

The device will clearly be designed to meet the working conditions under which the device will be used. Thus it will have a safe working load rating indicating the loads which can safely be lifted by the device.

Modifications of the invention are possible within the scope of the appended claims. For example, in a device according to the invention adapted to be used in conjunction with two or more chain or belt slings, there may be two or more of said guide wheels arranged side by side and operating on the principle described herein. Additionally, in a further modification, the device may embody a guard or retaining plate which locates above but not in contact with the guide wheel in order to prevent the chain or belt from jumping clear of the guide wheel pockets, recesses or surfaces. Such guide or retention means could for example be fixed to the guide wheel axle so that it will move with the guide wheel between the various positions thereof, and in all positions will perform the chain retaining function.

The device may embody or be connected to a means for indicating a load which is being lifted. Such means may comprise a strain gauge with associated visual display device carried by the device or located nearby an operators' station so that the weight of the load being lifted at any time can be viewed.

I claim:

1. In a lifting device for lifting a load and comprising:
(a) a support block comprising a pair of spaced side plates having a top end and a bottom end;
(b) slots in said side plates and extending in a direction from top to bottom of said side plates;
(c) a guide wheel assembly comprising a spindle and a guide wheel body;
(d) ends on said spindle, said spindle ends received in said slots;
(e) sprocket teeth on said guide wheel body;
(f) a locking pin extending between said plates and located at the bottom ends of the side plates;
(g) spring means connected between the ends of the spindle and the side plates urging the wheel assembly towards the top ends of said side plates;
(h) suspension means at the top ends of the side plates by which the device may be suspended by a crane hook;
(i) a length of flexible suspension member passing over the wheel body and of which the ends are attached to a load when in use, the tension in the load-producing a tension in the suspension member urging the wheel assembly towards the bottom ends of the side plates against the spring means, in which position the pin engages between the said teeth preventing rotation of the guide wheel body relative to the side plates, the improvement residing in that said slots and spindle are so arranged when the load supported by the device is greater than the spring force of the spring means the spindle rests on the bottom of the slots so that the plates take the load, the pin between the teeth taking no direct loading but serving only as a means resisting the turning of the guide wheel body.

2. A lifting device according to claim 1, wherein said guide wheel comprising flats on said spindle ends engaging said slots, preventing rotation of said spindle relative to the side plates.

3. A lifting device according to claim 1, wherein said spring means comprise a pair of springs respectively connected between the ends of said spindle and the side plates.

4. A lifting device according to any claim 1, wherein the flexible member is a link chain, and the guide wheel periphery has pockets for drivingly receiving the links on the link chain.

5. A lifting device according to claim 1, wherein the flexible member comprises a length of friction belt which wraps round the periphery of the guide wheel so as to frictionally engage same.

6. A device according to claim 5, wherein there are guide pulleys holding the belt to the guide wheel so that it wraps round an angle of more than 180°.

7. A device according to claim 5, wherein the belt is a flat belt, and the wheel periphery engaged by the belt is cylindrical.

8. A device according to claim 7, wherein the belt is of rubber or reinforced rubber, and the wheel periphery engaged by the belt is of like material.

9. A device according to claim 1, wherein the flexible member is a length of sling rope, and the wheel periphery has a V-groove in which the sling rope engages.

10. A device according to claim 9, wherein the sling rope is of rubber or reinforced rubber, and the surface of the V-groove engaged by the rope is of like material.

11. A device according to claim 1, wherein the teeth of the guide wheel are pointed at the ends and the pin is of circular cross-section.

* * * * *